US010364964B2

(12) United States Patent
Matsubayashi et al.

(10) Patent No.: US 10,364,964 B2
(45) Date of Patent: Jul. 30, 2019

(54) LIGHTING APPARATUS

(71) Applicant: PANASONIC INTELLECTUAL PROPERTY MANAGEMENT CO., LTD., Osaka (JP)

(72) Inventors: Yoko Matsubayashi, Osaka (JP); Hiroko Koiwa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 208 days.

(21) Appl. No.: 15/447,804

(22) Filed: Mar. 2, 2017

(65) Prior Publication Data

US 2017/0254511 A1 Sep. 7, 2017

(30) Foreign Application Priority Data

Mar. 3, 2016 (JP) ..... 2016-041570

(51) Int. Cl.

| | |
|---|---|
| ***F21V 13/04*** | (2006.01) |
| ***F21V 5/04*** | (2006.01) |
| ***F21V 7/00*** | (2006.01) |
| ***F21V 21/30*** | (2006.01) |
| ***F21V 23/00*** | (2015.01) |

(Continued)

(52) U.S. Cl.

CPC ..... *F21V 13/04* (2013.01); *F21S 8/04* (2013.01); *F21V 3/062* (2018.02); *F21V 5/04* (2013.01); *F21V 7/00* (2013.01); *F21V 19/02* (2013.01); *F21V 21/30* (2013.01); *F21V 23/003* (2013.01); *F21K 9/20* (2016.08); *F21K 9/68* (2016.08);

(Continued)

(58) Field of Classification Search

CPC .... F21Y 2113/00; F21Y 2115/10; F21K 9/00; F21S 8/04; F21V 13/04; F21V 21/30; F21V 23/003; F21V 7/00

See application file for complete search history.

(56) References Cited

U.S. PATENT DOCUMENTS 7,229,199 B2 * 6/2007 Lee ..... G02F 1/133602 362/240
8,585,242 B2 * 11/2013 Walczak ..... F21S 4/00 362/249.02

(Continued)

FOREIGN PATENT DOCUMENTS

JP 4-137305 5/1992
JP 2003-237464 8/2003

(Continued)

OTHER PUBLICATIONS

U.S. Appl. No. 15/447,706 to Yoko Matsubayashi et al., filed Mar. 2, 2017.

(Continued)

*Primary Examiner* — Peggy A Neils

(74) *Attorney, Agent, or Firm* — Greenblum & Bernstein, P.L.C.

(57) ABSTRACT

A lighting apparatus is provided. The lighting apparatus includes a first light source module and a second light source module surrounding the first light source module. A half beam angle of the first light source module is smaller than a half beam angle of the second light source module. A correlated color temperature of light from the first light source module is higher than a correlated color temperature of light from the second light source module.

20 Claims, 10 Drawing Sheets

(51) Int. Cl.

| | |
|---|---|
| ***F21S 8/04*** | (2006.01) |
| ***F21V 19/02*** | (2006.01) |
| ***F21V 3/06*** | (2018.01) |
| ***F21Y 113/00*** | (2016.01) |
| ***F21K 9/20*** | (2016.01) |
| ***F21Y 115/10*** | (2016.01) |
| ***F21K 9/68*** | (2016.01) |

(52) U.S. Cl.
CPC ..... *F21Y 2113/00* (2013.01); *F21Y 2115/10* (2016.08)

(56) References Cited

U.S. PATENT DOCUMENTS

| | | | | |
|---|---|---|---|---|
| 8,840,269 | B2 * | 9/2014 | Kang | F21V 3/00 362/241 |
| 9,039,254 | B2 * | 5/2015 | Danesh | F21V 21/30 362/364 |
| 9,084,305 | B2 | 7/2015 | Toda et al. | |
| 9,163,790 | B2 | 10/2015 | Ogata et al. | |
| 9,404,640 | B2 * | 8/2016 | Zhang | F21K 9/60 |
| 9,544,968 | B2 | 1/2017 | Matsubayashi et al. | |
| 9,696,007 | B2 * | 7/2017 | Min | F21V 7/0025 |
| 2007/0070625 | A1 * | 3/2007 | Bang | G02F 1/133603 362/240 |
| 2007/0291467 | A1 * | 12/2007 | Nagai | H05B 33/0857 362/84 |
| 2013/0010473 | A1 * | 1/2013 | Dellian | F21V 15/013 362/249.02 |
| 2013/0329420 | A1 * | 12/2013 | Matsubayashi | H05B 33/0857 362/231 |
| 2016/0076709 | A1 | 3/2016 | Matsubayashi et al. | |

FOREIGN PATENT DOCUMENTS

| | | |
|---|---|---|
| JP | 2005-302500 | 10/2005 |
| JP | 2014-075186 | 4/2014 |

OTHER PUBLICATIONS

U.S. Appl. No. 15/447,760 to Yoko Matsubayashi et al., filed Mar. 2, 2017.

* cited by examiner

LIGHTING APPARATUS

CROSS REFERENCE TO RELATED APPLICATION

This application claims the benefit of priority of Japanese Patent Application Number 2016-041570 filed on Mar. 3, 2016, the entire content of which is hereby incorporated by reference.

BACKGROUND

1. Technical Field

The present disclosure relates to a lighting apparatus, and in particular to a lighting apparatus for correcting a change in visual performance due to aging.

2. Description of the Related Art

According to the arrival of an aging society, there has been a great demand for a comfortable environment for middle and older aged people. In particular, improvement in visual environment achieved by lighting is an urgent issue. It is thus necessary to clarify how lighting can correct a change in human visual system caused by aging. Examples of a change in visual performance due to aging mainly include (a) a fall in transmittance of a crystalline lens, in particular a fall in transmittance of a crystalline lens in a short wavelength range, and (b) a bleary eye (intraocular scattering) due to a cataract (a crystalline lens clouding over).

In order to address (a), lighting which increases a proportion of blue light that reaches a retina by intensifying light in a wavelength range where a transmittance of a crystalline lens falls, or in other words, by causing light to have a so-called high color temperature is recommended for middle and older aged people, as disclosed in Japanese Unexamined Patent Application Publication No. 2003-237464.

Furthermore, there is a method of intensifying blue light components in order to take also (b) into consideration, as disclosed in Japanese Unexamined Patent Application Publication No. H04-137305. Japanese Unexamined Patent Application Publication No. H04-137305 recommends lighting which reduces glare by mainly reducing light in a wavelength range (of 470 nm to 530 nm inclusive) which has strong influence on glare, and thus yields advantageous effects of allowing users to perceive high contrast, high lightness, and high color saturation.

Taking (b) into consideration, there is also a method of adjusting a color-variable wall in order to reduce intraocular scattering due to ambient light, as disclosed in Japanese Unexamined Patent Application Publication No. 2005-302500.

SUMMARY

When conducting visual work, middle and older aged people need high brightness, which is said to be 2 to 5 times as high as the brightness that younger aged people need. Accordingly, there has been a demand for a lighting apparatus for middle and older aged people which does not give glare, but gives light having high illuminance and makes colors appear highly vivid.

Accordingly, the present disclosure provides a lighting apparatus which prevents letters and objects that middle and older aged people view from appearing to have lower color saturation, while reducing glare that the middle and older aged people perceive.

A lighting apparatus according to an aspect of the present disclosure includes: a first light source module; and a second light source module surrounding the first light source module, wherein a half beam angle of the first light source module is smaller than a half beam angle of the second light source module, and a correlated color temperature of light from the first light source module is higher than a correlated color temperature of light from the second light source module.

According to the present disclosure, letters and objects that middle and older aged people view are prevented from appearing to have lower color saturation, while reducing glare that the middle and older aged people perceive.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

The following specifically describes embodiments, with reference to the drawings. The embodiments described below each show a general or specific example. The numerical values, shapes, materials, elements, the arrangement and connection of the elements, and others indicated in the following exemplary embodiments are mere examples, and therefore are not intended to limit the present disclosure. Thus, among the elements in the following exemplary embodiments, elements not recited in any independent claim defining the most generic concept are described as arbitrary elements. It should be noted that the drawings are schematic diagrams, and do not necessarily provide strictly accurate illustration.

[Entire Configuration]

The following describes a lighting apparatus according to an embodiment.

Figure 1:
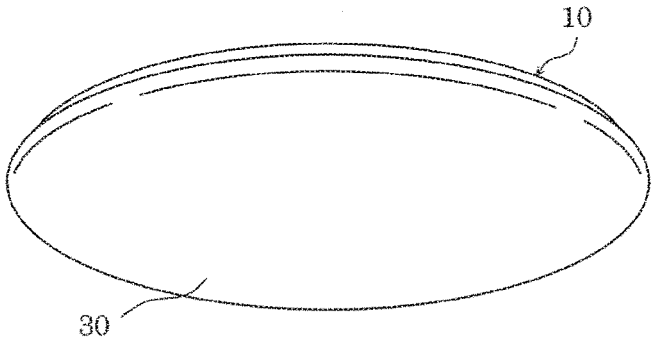
FIG. 1 is a perspective view illustrating a schematic structure of a lighting apparatus according to an embodiment.
Figure 2:
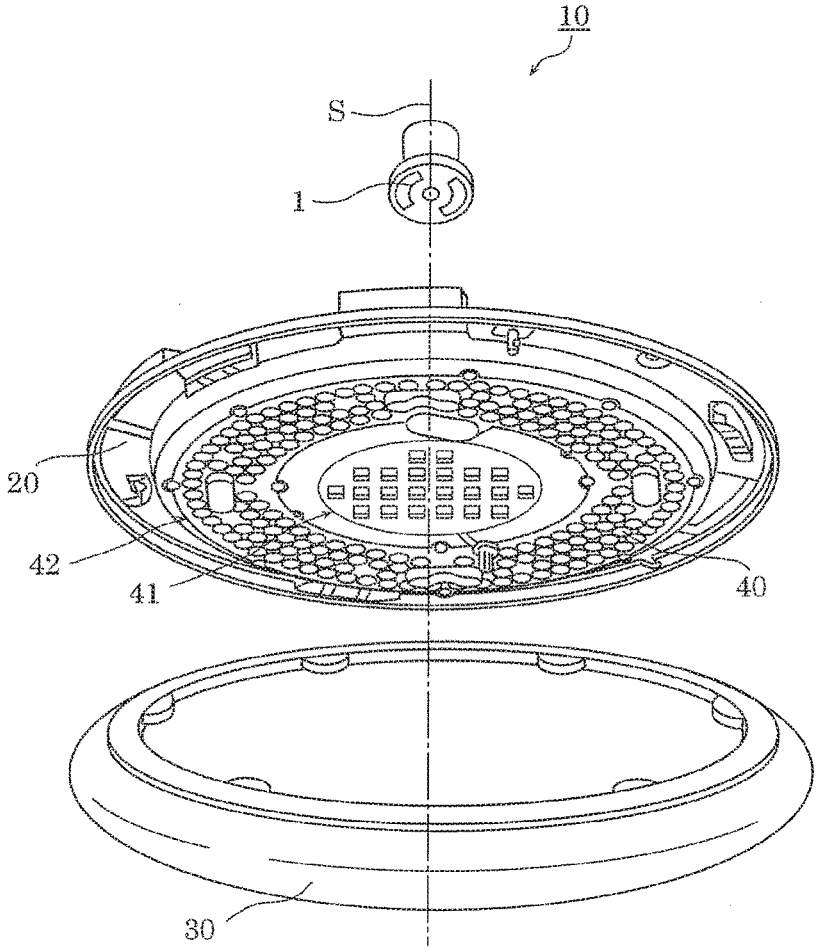
FIG. 2 is an exploded perspective view illustrating the schematic structure of the lighting apparatus according to the embodiment.
Figure 3:
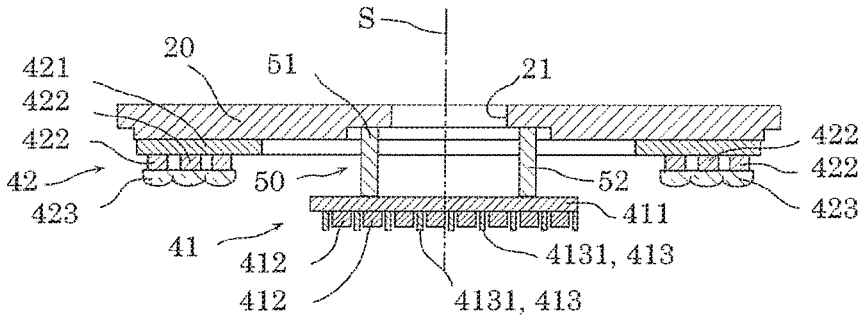
FIG. 3 is a schematic cross section illustrating a device body and others of the lighting apparatus according to the embodiment.

FIG. 1 is a perspective view illustrating a schematic structure of a lighting apparatus according to an embodiment. FIG. 2 is an exploded perspective view illustrating the schematic structure of the lighting apparatus according to the embodiment. FIG. 3 is a schematic cross section illustrating a device body and others of the lighting apparatus, according to the embodiment.

As illustrated in FIGS. 1 to 3, lighting apparatus 10 includes device body 20, cover 30, first light source module 41, second light source module 42, and pivot mechanism 50. Lighting apparatus 10 is detachably attached to, for example, hook ceiling body 1 provided on the ceiling of a building such as a house.

Device body 20 is a casing or holding cover 30, first light source module 41, and second light source module 42. Device body 20 is formed in a ring shape having circular opening 21 in the center portion. Hook ceiling body 1 is electrically connected to first light source module 41 and second light source module 42 through opening 21.

Note that device body 20 is formed in the stated shape by performing press working on sheet metal such as an aluminum plate or a steel plate, for example. In order to increase reflexibility to improve light extraction efficiency, white coating is applied onto or a reflexive metal material is vapor-deposited onto an inner surface (floor-side surface) on one side of device body 20.

Cover 30 is an external cover for covering the entire inner surface of device body 20, and is detachably attached to device body 20. Accordingly, first light source module 41 and second light source module 42 are disposed on the inner side of cover 30. Cover 30 is formed in a circular dome shape. Cover 30 is formed of a light-transmissive resin material such as, for example, acrylics (PMMA), polycarbonate (PC), polyethylene terephthalate (PET), or polyvinyl chloride (PVC). Accordingly, light emitted from first light source module 41 and second light source module 42 toward the inner surface of cover 30 passes and exits through cover 30. Note that cover 413 may be given light diffusibility by forming cover 30 with a semi-opaque resin material.

First light source module 41 is a first light source for emitting white light, for example. First light source module 41 is attached to an approximately center portion of device body 20 so as to cover and expose opening 21 of device body 20. Specifically, first light source module 41 includes disk-shaped substrate 411, first light emitting elements 412 mounted on a mounting surface (floor-side surface) of substrate 411, and first light distributor 413 which controls distribution of light emitted by first light emitting elements 412.

Substrate 411 is a printed-circuit board for mounting first light emitting elements 412. A wiring pattern (not illustrated) for mounting first light emitting elements 412 is formed on substrate 411. The wiring pattern is for supplying direct current from a circuit portion (including constant-power output circuit 11 and control circuit 12: see FIG. 9) to first light emitting elements 412, by electrically connecting first light emitting elements 412 to the circuit portion.

First light emitting elements 412 are arranged substantially evenly on the mounting surface of substrate 411. First light emitting elements 412 are, for example, packaged surface-mount white LED elements (SMDs: surface mount devices).

First light distributor 413 is an optical member which refracts light emitted by first light emitting elements 412, toward central axis S (see FIG. 2) of lighting apparatus 10. In other words, first light distributor 413 is an optical member for controlling an angle at which light emitted by first light emitting elements 412 is distributed.

Figure 4:
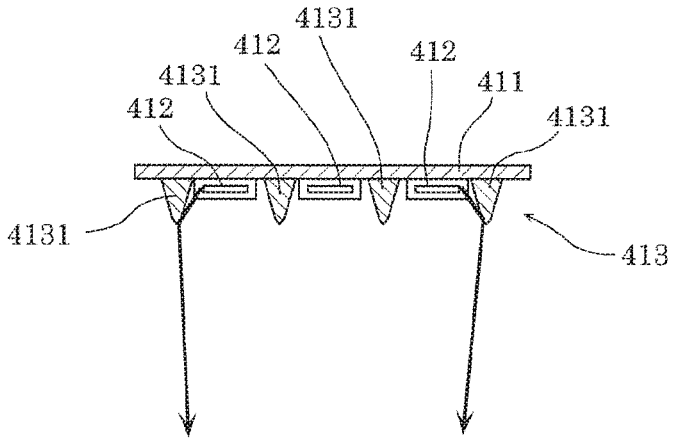
FIG. 4 is a cross-sectional view schematically illustrating an example of a first light distributor according to the embodiment.

FIG. 4 is a cross-sectional view schematically illustrating an example of first light distributor 413 according to the embodiment.

As illustrated in FIG. 4, first light distributor 413 includes reflection members 4131 which are protruding from substrate 411 and surrounding first light emitting elements 412. Reflection members 4131 are each formed in a shape whose cross section is an isosceles triangle having a bottom on substrate 411. The lateral surface of each reflection member 4131 serves as a reflective surface, and reflects (refracts) light emitted from first light emitting elements 412 toward central axis S. Accordingly, the light distribution angle of first light source module 41 can be made smaller than the light distribution angle in the case where no first light distributor 413 is included.

Note that first light distributor 413 may have any shape as long as first light distributor 413 can decrease the light distribution angle of first light source module 41.

Figure 5:
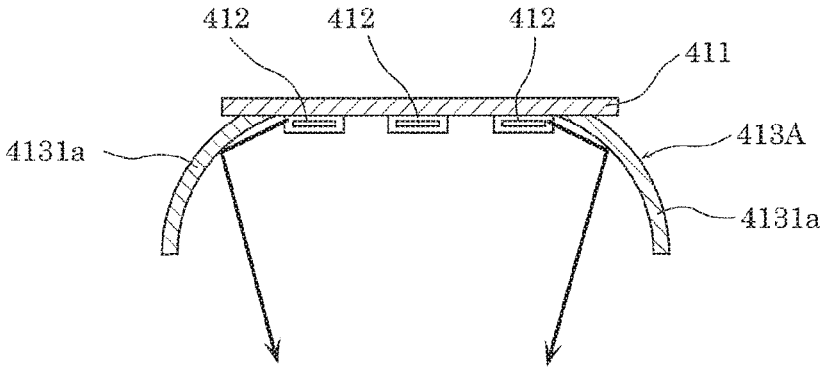
FIG. 5 is a cross-sectional view schematically illustrating another example of the first light distributor according to the embodiment.
Figure 6:
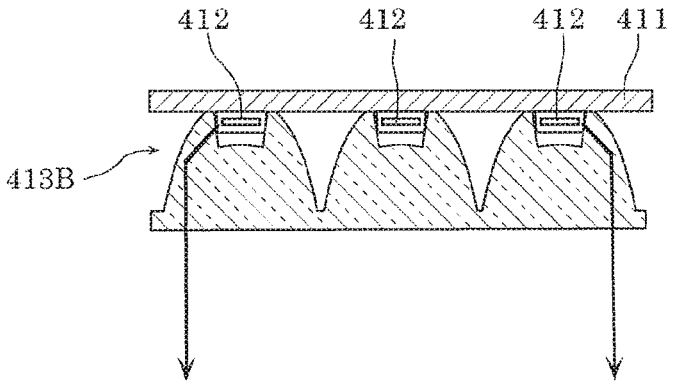
FIG. 6 is a cross-sectional view schematically illustrating another example of the first light, distributor according to the embodiment.

FIGS. 5 and 6 are cross-sectional views schematically illustrating other examples of the first light distributor according to the embodiment.

With first light distributor 413 illustrated in FIG. 4, reflection members 4131 individually surround first light emitting elements 412, whereas with first light distributor 413A illustrated in FIG. 5, reflection member 4131*a* surrounds first light emitting elements 412. In this manner, light emitted by first light emitting elements 412 is collectively reflected by reflection member 4131*a* so as to be directed inward, and thus the light distribution angle of entire first light source module 41 can be decreased.

First light distributor 413B illustrated in FIG. 6 includes lenses facing light emitting surfaces of first light emitting elements 412 in one-to-one correspondence. First light distributor 413B can decrease the light distribution angle of entire first light source module 41, by inwardly refracting light emitted by first light emitting elements 412.

As illustrated in FIGS. 1 to 3, second light source module 42 is a second light source for emitting white light, for example. Second light source module 42 includes substrate 421 having a ring shape, second light emitting elements 422 mounted on a mounting surface (floor-side surface) of substrate 421, and second light distributor 423 which controls distribution of light emitted by second light emitting elements 422.

Substrate 421 is a printed-circuit board for mounting second light emitting elements 422. A wiring pattern (not illustrated) for mounting second light emitting elements 422 is formed on substrate 421. The wiring pattern is for supplying direct current from a circuit portion (including constant-power output circuit 11 and control circuit 12: see FIG. 9) to second light emitting elements 422, by electrically connecting second light emitting elements 422 to the circuit portion.

Second light emitting elements 422 are arranged on substrate 421 in multiple rings. Second light emitting elements 422 are surface-mount white LED elements, for example.

Second light distributor 423 is an optical member for controlling the distribution angle of light emitted by second light emitting elements 422. Specifically, second light distributor 423 includes lenses disposed on the light emitting side of second light emitting elements 422 in one-to-one correspondence. Note that second light distributor 423 may not include lenses, but may be a reflection member similar to first light distributor 413.

Pivot mechanism 50 includes pivot shaft 51 which pivotally holds substrate 411 of first light source module 41, and restriction shaft 52 which restricts the pivot of first light source module 41.

Pivot shaft 51 is protruding from the edge of opening 21 of device body 20. Substrate 411 of first light source module 41 is pivotably supported at a tip portion of pivot shaft 51.

Restriction shaft 52 is protruding from the edge of opening 21 of device body 20. Restriction shaft 52 is disposed across opening 21 from pivot shaft 51. Restriction shaft 52 restricts the pivot of substrate 411 by a tip portion being engaged with substrate 411 of first light source module 41.

Figure 7:
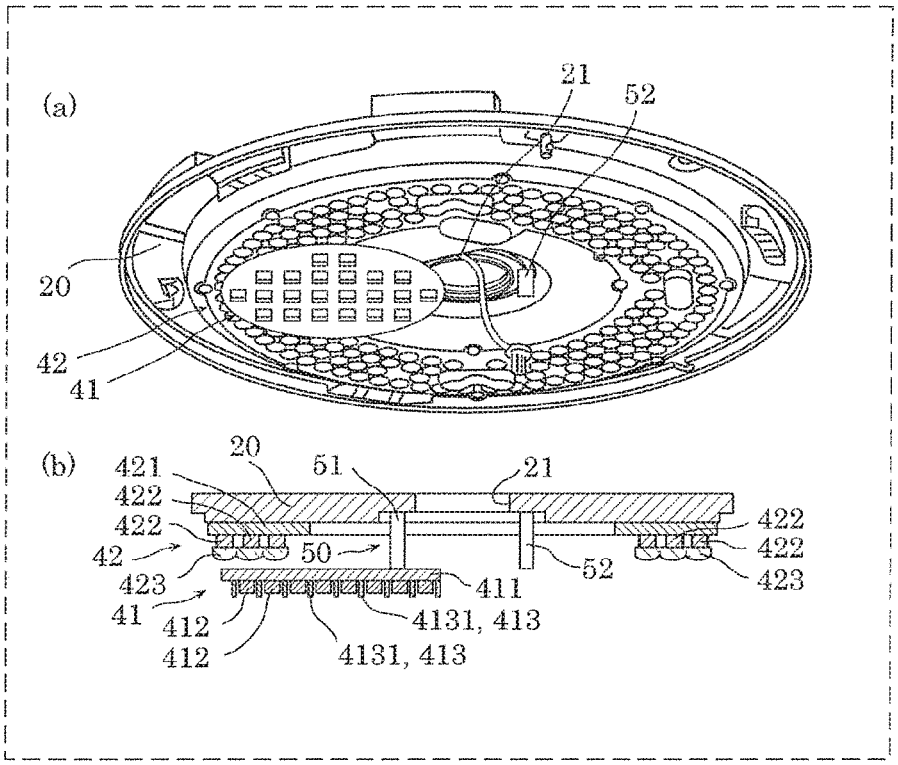
FIG. 7 is an explanatory diagram illustrating a state in which a first light source module according to the embodiment is not covering an opening.

FIG. 7 is an explanatory diagram illustrating a state where first light source module 41 according to the embodiment is not covering opening 21, where (a) of MG. 7 is a perspective view of device body 20, and (b) of FIG. 7 is a cross-sectional view of device body 20.

FIGS. 2 and 3 illustrate a state where first light source module 41 is covering opening 21, and substrate 411 of first light source module 41 is caused to pivot about pivot shaft 51 from this state, thus exposing opening 21 as illustrated in FIG. 7. Such exposure of opening 21 allows first light source module 41 and second light source module 42 to be readily electrically connected with hook ceiling body 1.

The following describes in detail first light emitting elements 412 and second light emitting elements 422.

First light emitting elements 412 have a spectral emission property defined by a correlated color temperature of light being at least 5400 K and at most 7000 K, Duv being in a range of −6 to 5 inclusive, a chroma value calculated using a calculation method specified in the CIE 1997 Interim Color Appearance Model (Simple Version) being 2.7 or less, and general color rendering index Ra being 80 or more. Here, the chroma value is an index for quantitatively evaluating whitishness of an object to be viewed. Chromatic is less is high when the chroma value is large, whereas chromaticness is low when the chroma value is small. Accordingly, when the chroma value is small, whitishness is high. Under the light having a spectrum which achieves the chroma value of 2.7 or less, the correlated color temperature of at least 5400 K and at most 7000 K, and color deviation Duv in a range of −6 to 5 inclusive, the readability of printed letters on a piece of paper is increased, which is already known (for example, Japanese Unexamined Patent Application Publication No. 2014-75186). Furthermore, general color rendering index Ra is an index for evaluating faithful reproducibility of a color, and JIS 29112 "Classification of fluorescent lamps and light emitting diodes by chromaticity and colour rendering property" shows a criterion for the index. Specifically, general color rendering index Ra may be 80 or more. If first light emitting elements 412 has the above spectral emission property, a color can be faithfully reproduced while readability of letters printed on a piece of paper is increased.

Second light emitting elements 422 have a spectral emission property defined by a correlated color temperature of light being lower than a correlated color temperature of light emitted by first light emitting elements 412.

Figure 8:
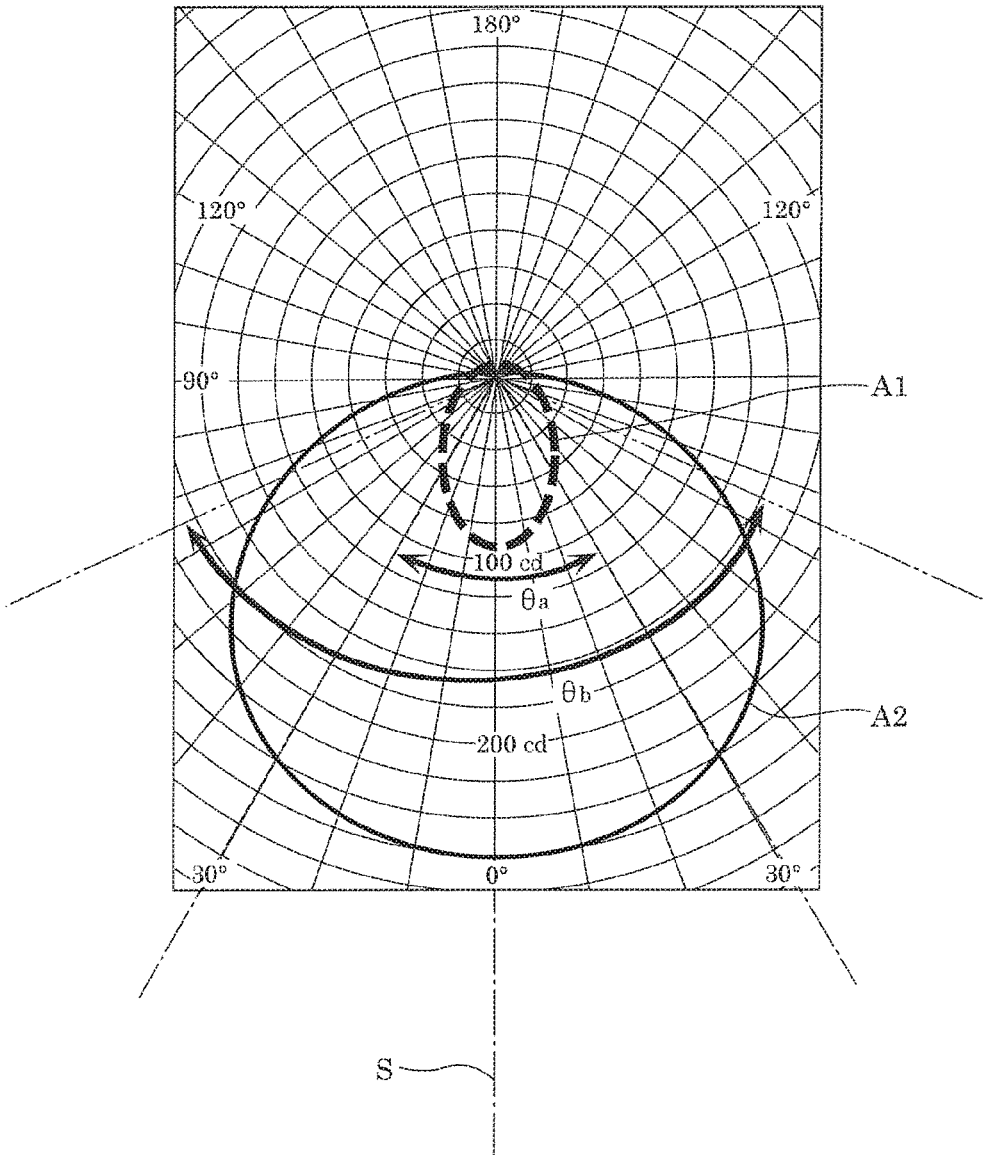
FIG. 8 is an explanatory diagram illustrating luminous intensity distribution curves of the first light source module and a second light source module according to the embodiment.

FIG. 8 is an explanatory diagram illustrating the luminous intensity distribution curves of first light source module 41 and second light source module 42 according to the embodiment.

As illustrated in FIG. 8, luminous intensity distribution curve A1 of light from first light source module 41 which has passed through cover 30 is smaller as a whole than luminous intensity distribution curve A2 of light from second light source module 42 which has passed through cover 30. Half beam angle $\theta_a$ of light from first light source module 41 which has passed through cover 30 is smaller than half beam angle $\theta_b$ of light from second light source module 42. Here, a half beam angle is twice the angle between an optical axis (central axis S) and a direction in which light emitted from lighting apparatus 10 has half the brightness of the maximum brightness.

The arrangement of first light emitting elements 412 and second light emitting elements 422 and optical properties of first light distributor 413 and second light distributor 423, for instance, are determined so that half beam angle $\theta_a$ of first light source module 41 and half beam angle $\theta_b$ of second light source module 42 satisfies the above relation.

Accordingly, the task region immediately under lighting apparatus 10 is illuminated with light emitted by first light source module 41, thus achieving task illumination. The ambient region around the task region is illuminated with light emitted by the second light source module, thus achieving ambient illumination (indoor environmental lighting).

Figure 9:
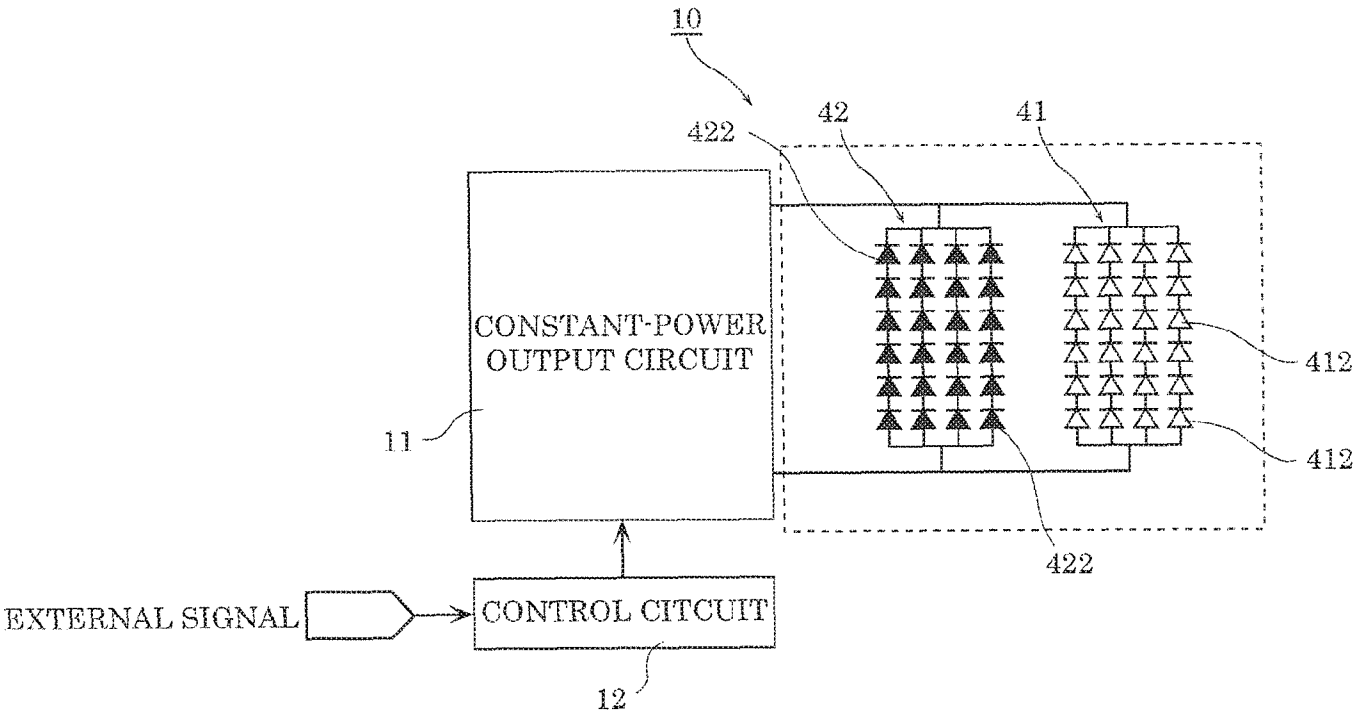
FIG. 9 is a block diagram illustrating a main control configuration of the lighting apparatus according to the embodiment.

FIG. 9 is a block diagram illustrating a main control configuration of lighting apparatus 10 according to the embodiment.

As illustrated in FIG. 9, lighting apparatus 10 includes constant-power output circuit 11 and control circuit 12.

Constant-power output circuit 11 is a circuit for supplying constant power to first light emitting elements 412 and second light emitting elements 422.

Control circuit 12 is a controller which controls an output from first light emitting elements 412 according to an output from second light emitting elements 422, by controlling constant-power output circuit 11. Control circuit 12 controls constant-power output circuit 11 when an external signal for lighting is input by, for example, a light-cm switch which is not illustrated being turned on, and controls an output from first light emitting elements 412 according to an output from second light emitting elements 422.

First light emitting elements 412 are divided into a plurality of groups, and the groups of first light emitting elements 412 are electrically connected parallel to constant-power output circuit 11. Furthermore, first light emitting elements 412 in each group are electrically connected in series.

Similarly, second light emitting elements 422 are divided into a plurality of groups, and the groups of second light emitting elements 422 are electrically connected parallel to constant-power output circuit 11. Furthermore, second light emitting elements 422 in each group are electrically connected in series.

In this manner, control circuit 12 controls an output from first light emitting elements 412 of first light distributor 41 according to an output from second light emitting elements 422 of second light distributor 42, by controlling constant-power output circuit 11.

[Verification Experiment 1]

How different influence of environmental lighting would be for middle and older aged people and younger aged people when they work was examined by experiment.

12 older people (aged 65 to 75) and 5 younger people (aged 21 to 23) were the subjects in the experiment. The experiment was conducted in a laboratory (4 m×4 m×2.7 m) surrounded by blackout curtains. In the middle of the laboratory, a worktable was placed, and a task light was placed 30 cm above the worktable. In the experiment, under lighting conditions having different ambient illuminances (50 lx, 150 lx, 750 lx), each subject selected a lower limit at which the subject starts feeling that "if the illuminance is any lower, the work surface is too dark," an upper limit at which the subject starts feeling that "if the illuminance is any higher, the work surface is too bright," and an optimum value at which the subject feels "the illuminance is best suitable for work."

As a result, the lower limit for the older aged people is turned out to be higher than the lower limit for younger people, and the upper limit for the older aged people is turned out to be lower than the upper limit for younger people. Thus, this shows that a permissible illuminance range for older people is narrower than the range for younger people, and illumination thus needs to be planed more carefully for older people.

Furthermore, the result shows that with regard to an appropriate relation between ambient illuminance and task illuminance for older people, if the ambient illuminance is in a range of 15 lx to 1000 lx inclusive, the task illuminance is at least 2.20 lx and at most 1000 lx, or even at least 450 lx and at most 1000 lx. The task illuminance is an illuminance of light emitted from first light source module 41, and the ambient illuminance is an illuminance of light emitted from second light source module 42.

Older people tend to perceive glare if the ambient illuminance is high, and thus the optimal illuminance has a negative correlation relative to the ambient illuminance.

Figure 10:
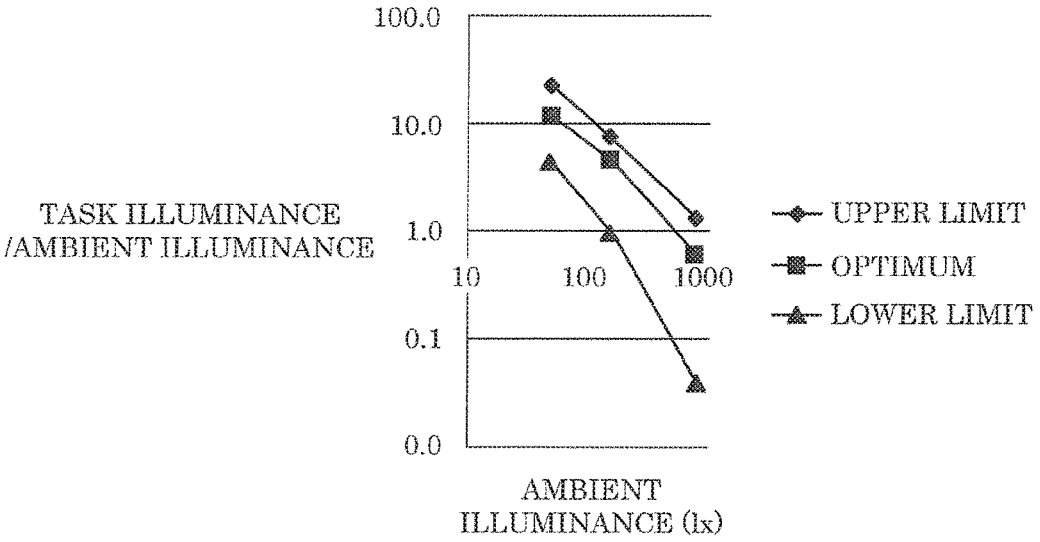
FIG. 10 is a graph illustrating an upper limit, an optimum value, and a lower limit for middle and older aged people of a relation between an ambient illuminance and a ratio of a task illuminance to an ambient illuminance.

FIG. 10 is a graph illustrating an upper limit, an optimum value, and a lower limit for middle and older aged people, in a relation between ambient illuminance and a ratio of task illuminance to ambient illuminance. FIG. 10 also illustrates fit curves of upper limit, optimum value, and lower limit.

If the task illuminance is changed in the range of upper limit and lower limit, according to the ambient illuminance, light environment for middle and older aged people can be achieved, which also handles differences in settings made by users. Specifically, control circuit 12 may control first light emitting elements 412 of first light source module 41 according to second light emitting elements 422 of second light source module 42, by controlling constant-power output circuit 11.

For example, if ambient illuminance is in a range of 150 lx to 1000 lx inclusive, task illuminance=ambient illuminance×2850×ambient illuminance$^{-1.28}$. If ambient illuminance is less than 150 lx, task illuminance is fixed at 700 lx or task illuminance=ambient illuminance+550 lx.

If the task illuminance is controlled according to the ambient illuminance in the above manner, task illuminance appropriate for each of middle and older aged people can be automatically and individually achieved.

[Verification Experiment 2]

Next, a relation between illuminance and readability achieved by a light color is examined by experiment.

The experiment was based on subjective evaluation, and readability of letters printed on a piece of paper depending on the illuminance and a light color (correlated color temperature) was evaluated. The illuminance level is at least 300 lx and at most 1000 ix, and the color temperature is at least 2700 K and at most 7000 K, which is determined taking into consideration the chromaticity range of white light described in JISZ9112 "Classification of fluorescent lamps and light emitting diodes by chromaticity and colour rendering property."

An object to be viewed was typical plain copying paper. 30 letters cited from Mr. Oda's reading chart (MNRED-J) were printed in the center of a piece of paper in 7 pt which is the type size for newspaper, and the viewing distance was 400 mm. For illumination light, a liquid crystal filter was combined with a xenon lamp, and an apparatus which can emit various spectral light by controlling the liquid crystal filter was used. The color of illumination light was changed to four levels, namely 2700 K, 5000 K, 6000 K, and 7000 K, and the illuminance at the center of the piece of paper was changed to five levels, namely 300 lx, 500 lx, 600 lx, 750 lx, and 1000 lx. The subjects were 30 people including men and women, aged from 23 to 69.

As the procedure of the experiment, the four light colors were presented randomly. Only the illuminance was variable while maintaining the selected light color, and five levels of illuminance were presented in ascending order. First, a subject took three minutes to adapt to a piece of paper having no printed letters while such illumination light was emitted, and thereafter conducted a ten-second task (silently read the 30 letters printed on the piece of paper), and then made subjective evaluation. Subsequently, the subject took one minute to adapt to the piece of paper having no printed letters, conducted the ten-second task, and made subjective evaluation, which were repeated five times in total. Next, the light color was changed, and the experiment following the same procedure was repeated four times in total.

The subjective evaluation was based on seven ranks, and each subject selected "readability" of the printed letters from among "very easy to read," "quite easy to read," "slightly easy to read," "not easy, but not hard to read," "slightly hard to read," "quite hard to read," and "very hard to read."

Figure 11:
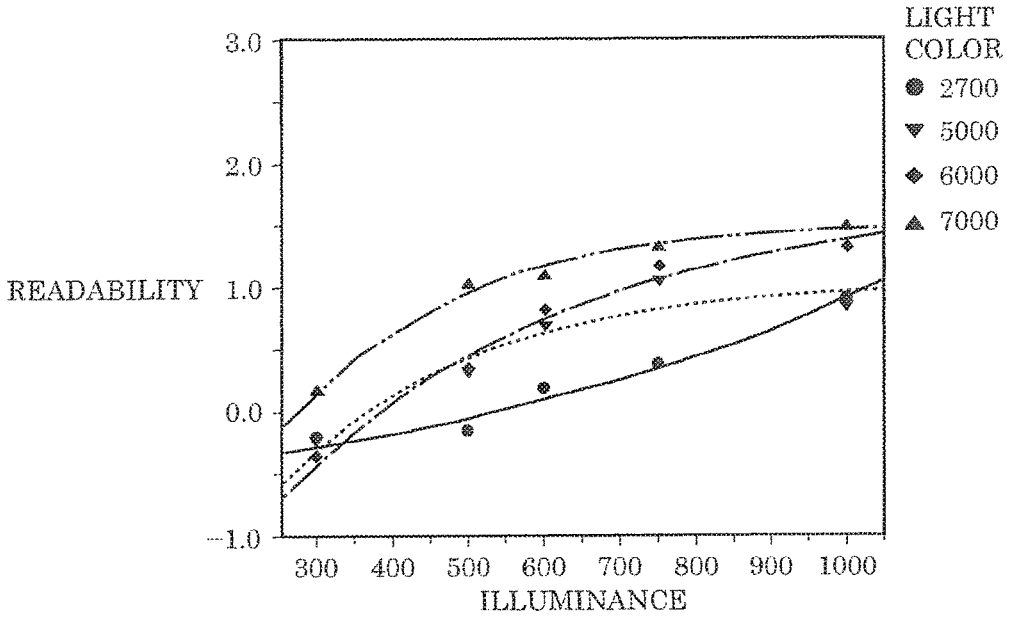
FIG. 11 is a graph illustrating evaluation results of subjects aged 50 and over in verification experiment 2.
Figure 12:
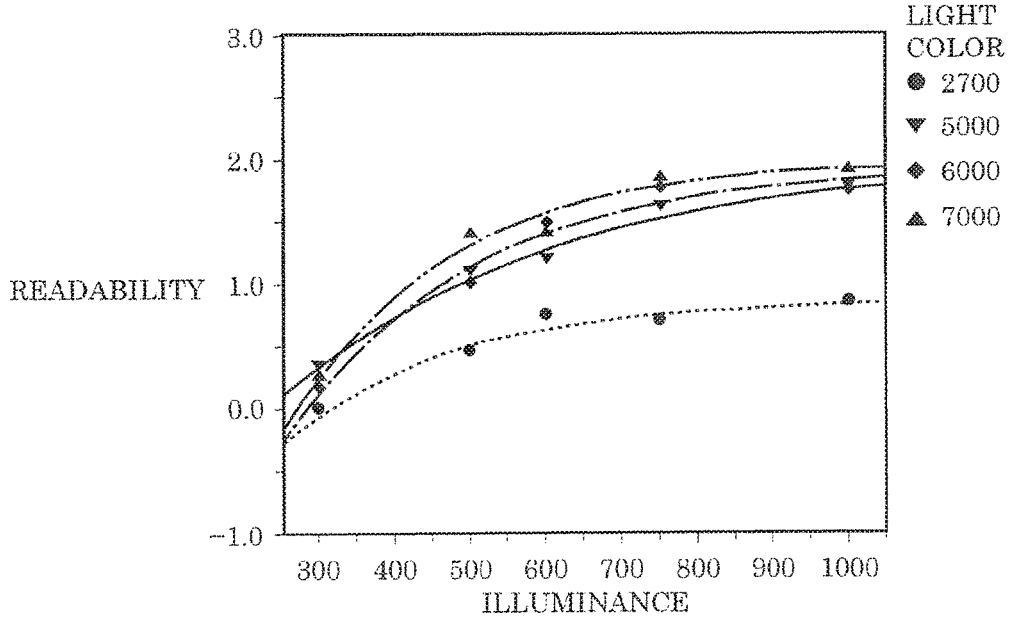
FIG. 12 is a graph illustrating evaluation results of subjects younger than 50 in verification experiment 2.

FIG. 11 is a graph illustrating results of evaluation by subjects aged 50 and over in verification experiment 2, and FIG. 12 is a graph illustrating results of evaluation by subjects younger than 50 in verification experiment 2.

The horizontal axes in FIGS. 11 and 12 indicate illuminance, whereas the vertical axes indicate evaluation values for readability which are plotted averages of 30 subjects. Note that the evaluation values for readability were 3, 2, 1, 0, −1, −2, −3 corresponding to "very easy to read," "quite easy to read," "slightly easy to read", "not easy, but not hard to read", "slightly hard to read", "quite hard to read", and "very hard to read", respectively, and obtained as arithmetic averages. As is clear from FIGS. 6 and 7, for both the group of subjects aged 50 and over and the group of subjects younger than 50, readability increases with illuminance, yet the rate of increase is different depending on a light color. In particular, readability at a high color temperature of 7000 K is higher than that at other color temperatures for the subjects aged 50 and over. This shows that a high color temperature renders letters more legible for middle and older aged people who are 50 and over. Thus, the light for the task region may have a higher color temperature than the light for the ambient region.

Experiment for "vividness" evaluation was conducted, in order to evaluate how colors appear to middle and older aged people.

For the experiment, three lighting conditions were employed (reference light: 5000 K (widely used), test 1 light: 6200 K (widely used), test 2 light: 6200 K (with high color rendering), illuminance of the reference light was changed to three levels (500 lx, 750 lx, 1000 lx), and subjects were ten in total, or more specifically, six subjects aged 45 to 65, both men and women (in middle age) and four subjects aged 25 to 44, both men and women (in maturing age). A ø120 downlight which emits the reference light and another ø120 downlight which emits test 1 or test 2 light were disposed in evaluation boxes (size: W300×D300×H500 [mm]/interior color: N7). The reference light evaluation box was disposed on the right, whereas the test evaluation box was disposed on the left, and paired comparison was made. Objects to be viewed were pieces of paper having JIS test colors (R9 red, R10 yellow, R11 green, R12 blue), and a 75-mm square window was provided in the center of a piece of N5 colored paper (lightness 5/gray). Then, a piece of JIS test colored paper was placed at the window. At this time, the viewing distance was 400 mm, and the angle at which a subject viewed test colored paper was 10.7 degrees.

The evaluation technique used was the method of limits. The illuminance of reference light was fixed, whereas the illuminance of test 1/test 2 light was variable. By paired comparison, a subject selected one evaluation box in which the test colored paper appeared more "vivid" (from among the reference light evaluation box and the test evaluation box) (two-point scale). The experiment was repeated three times each for an ascending series and a descending series.

As the procedure of the experiment, a subject took three minutes to adapt to the N5 colored paper in the reference light evaluation box, where no test colored paper was placed. After that, test colored paper was placed in each of the reference light evaluation box and the test evaluation box, while the illuminance of the reference light was fixed and the illuminance of test 1/test 2 light was adjusted. Specifically, when the illuminance of reference light was 500 lx, the illuminance of test 1/test 2 light was at least 150 lx and at most 520 lx. When the illuminance of reference light was 750 lx, the illuminance of test 1/test 2 light was at least 250 lx and at most 800 lx. When the illuminance of reference light was 1000 lx, the illuminance of test 1/test 2 light was at least 400 lx and at most 1060 lx. By paired comparison, the subject selected one evaluation box in which the test colored paper appeared more "vivid" (from among the reference light evaluation box and the test evaluation box). When the subject selected an evaluation box different from the one selected at the beginning, the evaluation for one series was terminated. Specifically, the evaluation was terminated when the subject selected the test evaluation box in the ascending series, and when the subject selected the reference light evaluation box in the descending series.

After conducting the experiment six times by alternating the experiment for the ascending series and the experiment for the descending series, the test colored paper was changed and four sets of the same experiment were repeatedly conducted.

After that, test 1 light and test 2 light were switched in the test evaluation box. The subject took one minute to adapt to the N5 colored paper, and thereafter test colored paper was placed. Then, the experiment was conducted six times by alternating the experiment for the ascending series and the experiment for the descending series, and thereafter the test colored paper was changed, and four sets of the same experiment were repeatedly conducted.

The subject compared the color paper in the evaluation box illuminated with the reference light having fixed illuminance (three levels: 500 lx, 750 lx, 1000 lx) and the color paper in the evaluation box illuminated with the test 1/test 2 light having variable illuminance. An average of six illuminance values of test light at which the evaluation box selected was changed to the other box (three illuminance values from the experiment for the ascending series, and three illuminance values from the experiment for the descending series) was used as a threshold.

Figure 13:
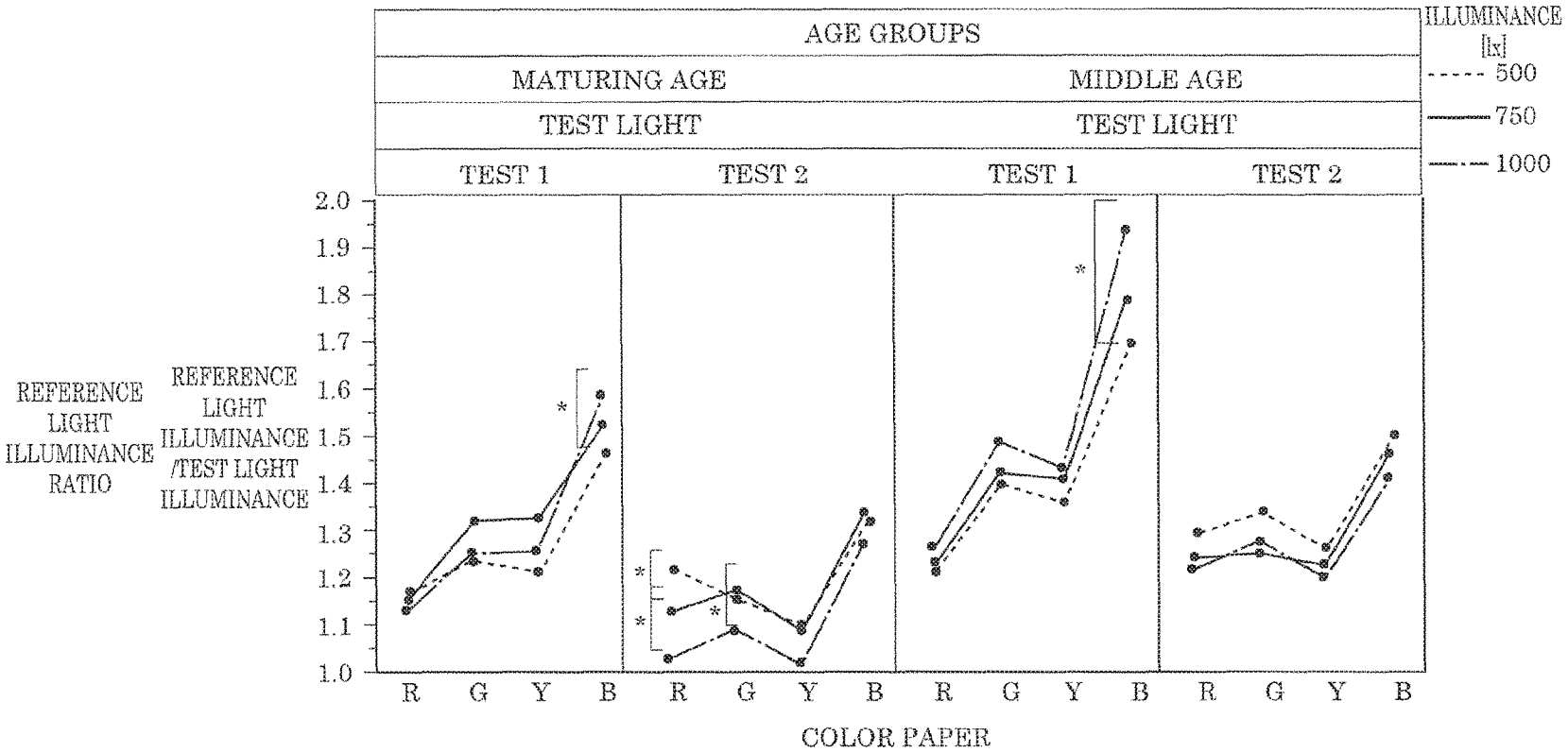
FIG. 13 is a graph illustrating results of calculating reference illuminance ratios used as thresholds in verification experiment 2.

FIG. 13 is a graph illustrating results of calculating the reference illuminance ratios used as thresholds in verification experiment 2. Note that the reference illuminance ratio=reference light illuminance (500 lx, 750 lx, 1000 lx)/test light illuminance (threshold). The test 2 light is obtained by decreasing an intensity of test 1 light at a wavelength of at least 570 nm and at most 780 nm.

As illustrated in FIG. 13, compared to reference light having 5000 K, it can be seen that both the test 1 light and the test 2 light having a high color temperature yield effects of improvements in how the color appears, namely "vividness," and are particularly effective for middle aged subjects.

The test 2 light has almost the same reference light illuminance ratios for the colors (color paper), and a better color balance than the reference light having 5000 K. This greatly contributes to improvement in color appearance.

Here, in general, middle and older aged people tend to perceive glare than young people, and more strongly perceive glare when light has a higher color temperature.

From the above, although employing light having a high color temperature is effective in improving appearance of letters and colors which deteriorates due to aging, such light increases intraocular scattering, and thus people tend to perceive glare. Accordingly, it can be seen that increasing the illuminance, color temperature, and color rendering in a task region immediately under lighting apparatus 10 (region where visibility is to be secured) and decreasing the color temperature in a peripheral region (ambient region) are effective in improving visibility of middle and older aged people.

From the above, the correlated color temperature of light from first light source module 41 which mainly illuminates the task region is set higher than the correlated color temperature of light from second light source module 42 which mainly illuminates the ambient region, thus improving visibility of middle and, older aged people.

As described above, according to present embodiment, lighting apparatus 10 includes: first light source module 41; and second light source module 42 surrounding first light source module 41. A half beam angle of first light source module 41 is smaller than a half beam angle of second light source module 42. A correlated color temperature of light from first light source module 41 is higher than a correlated color temperature of light from second light source module 42.

According to this, a task region immediately under lighting apparatus 10 can be illuminated with light having high illuminance and a high color temperature while the peripheral region (ambient region) is illuminated with light having a low color temperature. Thus, letters and objects that middle and older aged people view are prevented from appearing to have lower color saturation, while reducing glare that the middle and older aged people perceive.

First light source module 41 includes first light emitting element 412 having a spectral emission characteristic defined by a correlated color temperature of light being at least 5400 K and at most 7000 K, Duv being in a range of −6 to 5 inclusive, a chroma value calculated using a calculation method specified by the CIE 1997 Interim Color Appearance Model (Simple Version) being 2.7 or less, and a general color rendering index Ra being 80 or more. Second light source module includes second light emitting element 422 having a spectral emission characteristic defined by a correlated color temperature of light being lower than the correlated color temperature of the light emitted by first light emitting element 412.

As stated above, first light emitting element 412 has the above spectral emission property, and thus it is possible to faithfully reproduce a color while increasing readability of letters printed on a piece of paper in the task region.

Lighting apparatus 10 includes device body 20 which holds first light source module 41 and second light source module 42, and pivot mechanism 50 which causes first light source module 41 to pivot relative to device body 20.

In this manner, pivot mechanism 50 causes first light source module 41 to pivot relative to device body 20, and thus when lighting apparatus 10 is attached to the ceiling, pivot mechanism 50 can cause first light source module 41 to pivot and move. Accordingly, when device body 20 is attached to hook ceiling body 1, first light source module 41 can be displaced, and thus attachment work can be readily conducted.

Lighting apparatus 10 further includes control circuit 12 which controls an output from first light source module 41 according to an output from second light source module 42.

Accordingly, control circuit 12 controls first light source module 41 according to second light source module 42, and thus can change task illuminance according to the ambient illuminance. Light environment for middle and older aged people can be therefore achieved, which also handles differences in settings made by users.

Other Embodiments

The above has described the lighting apparatus according to the embodiment, yet the present disclosure is not limited to the above embodiment. Note that in the following description, the same element as that in the above embodiment may be given the same numeral, and a description of the element may be omitted.

For example, the above embodiment has described, as an example, a structure in which first light source module 41 opens and closes opening 21 of device body 20, yet a structure in which opening 21 is exposed at all times may be adopted.

Figure 14:
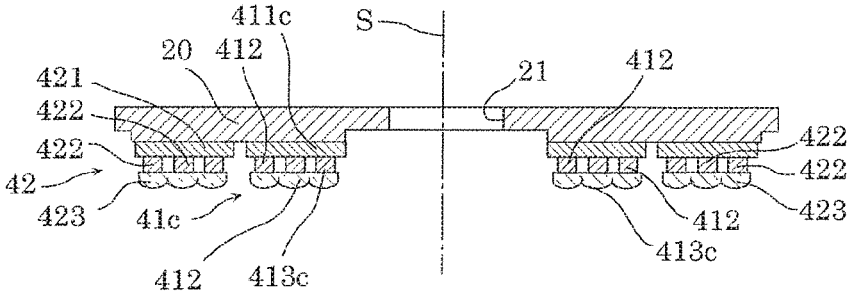
FIG. 14 is a schematic cross section illustrating a device body and others of a lighting apparatus according to a variation.

FIG. 14 is a schematic cross section illustrating a device body and others of a lighting apparatus according to a variation. Specifically, FIG. 14 corresponds to FIG. 3.

As illustrated in FIG. 14, substrate 411*c* of first light source module 41*c* is a ring-shaped substrate, and is disposed on the inner portion of substrate 421 of second light source module 42 so as to expose opening 21. Substrate 411*c* of first light source module 41*c* is fixed to device body 20.

First light emitting elements 412 are arranged and mounted on substrate 411*c* in multiple rings.

First light distributor 413*c* is an optical member for controlling the angle at which light emitted by first light emitting elements 412 is distributed. Specifically, first light distributor 413*c* includes lenses disposed on the light emission side of first light emitting elements 412 in one-to-one correspondence. First light distributor 413*c* is formed to refract light emitted by first light emitting elements 412 toward central axis S of lighting apparatus 10. In this manner, even when opening 21 is exposed, light emitted by first light emitting elements 412 can be concentrated on a spot immediately under lighting apparatus 10, a half beam angle of first light source module 41*c* can be made smaller than a half beans angle of second light source module 42.

Here, an intensity of light from first light source module 41*c* at a wavelength of at least 570 nm and at most 780 nm may be decreased. Specifically, the lenses included in first light distributor 413*c* may be formed using a mixture of optical absorption material which absorbs light having an intensity at a wavelength in a range of 570 nm to 780 nm inclusive. This improves the color balance of light emitted from first light source module 41*c*.

Note that an optical filter which decreases an intensity of light at a wavelength in a range of 570 nm to 780 nm inclusive may be provided separately from first light distributor 413*c*, and disposed on the light emission side of first light emitting elements 412.

The above embodiment has describes, as an example, the case where control circuit 12 controls an output from first light source module 41 according to an output from second light source module 42. However, control circuit 12 may control an output from first light source module 41 and an output from second light source module 42, separately. In this manner, illuminance of first light source module 41 and illuminance of second light, source module 42 can be controlled at finer levels.

Figure 15:
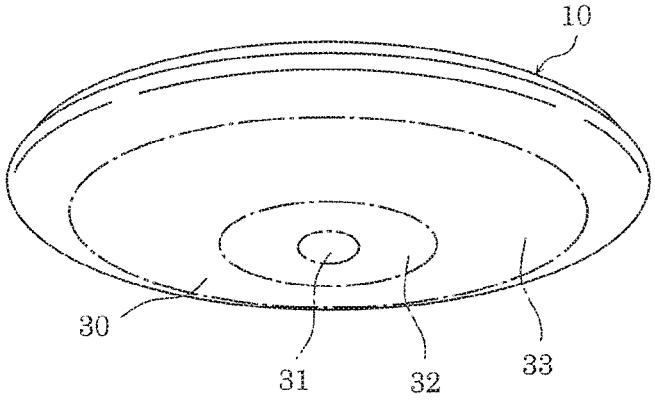
FIG. 15 is a perspective view for describing differences in transmittance of portions of a cover according to the variation.

FIG. 15 is a perspective view for describing differences in transmittances of portions of a cover according to the variation. As illustrated in FIG. 15, transmittances of center portion 31, inner periphery 32, and outer periphery 33 of cover 30 may be increased with a decrease in a distance to the center of cover 30. Specifically, the relation is as follows: transmittance of center 31>transmittance of inner periphery 32>transmittance of outer periphery 33. In this manner, the illuminance at central axis S of lighting apparatus 10 can be increased.

The lighting apparatus may further include: a first light distributor which is disposed on a light emission side of the first light source module, and refracts the light from the first light source module toward a central axis of the lighting apparatus.

The first light source module may include a plurality of light emitting elements, the first light distributor may include a plurality of reflection members, and the plurality of reflection members may individually surround the plurality of light emitting elements.

The plurality of reflection members may each include a cross-section being an isosceles triangle, the isosceles triangle having a bottom on the light emission side of the first light source module.

The plurality of light emitting elements may be arranged evenly on the light emission side of the first light source module.

The first light source module may include a plurality of light emitting elements, the first light distributor may include a plurality of reflection members, and the plurality of reflection members may collectively surround the plurality of light emitting elements.

The first light source module may include a plurality of light emitting elements, the first light distributor may include a plurality of lenses, and the plurality of lenses may face the plurality of light emitting elements in one-to-one correspondence.

The lighting apparatus may further include: a second light distributor which is disposed on a light emission side of the second light source module, and controls a distribution angle of the light from the second light source module.

The second light source module may include a plurality of light emitting elements, the second light distributor may include a plurality of lenses, and the plurality of lenses may face the plurality of light emitting elements in one-to-one correspondence.

The second light distributor may include a reflection member similar to the first light distributor.

The second light source module may include a substrate and a plurality of light emitting elements, the substrate may have a ring shape, and the plurality of light emitting elements may be arranged on the substrate in multiple rings.

The plurality of light emitting elements of the second light source module may comprise surface-mount white light emitting diodes.

A lighting apparatus may include: a first substrate; a plurality of first light emitting elements disposed on a mounting surface of the first substrate; a second substrate surrounding the first substrate; and a plurality of second light emitting elements disposed on a mounting surface of the second substrate, wherein a half beam angle of the plurality of first light emitting elements may be smaller than a half beam angle of the plurality of second light emitting elements, and a correlated color temperature of light from the plurality of first light emitting elements may be higher than a correlated color temperature of light from the plurality of second light emitting elements.

The first substrate may be a first printed-circuit board, and the second substrate may be a second printed-circuit board.

Note that aspects obtained by arbitrarily combining the configurations described in the above embodiment and the variation also fall within the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting apparatus, comprising:

a first light source module;

a second light source module surrounding the first light source module;

a casing which holds the first light source module and the second light source module; and a pivot which causes the first light source module to pivot relative to the casing, and causes the first light source module to pivot relative to the second light source module, wherein a half beam angle of the first light source module is smaller than a half beam angle of the second light source module, and a correlated color temperature of light from the first light source module is higher than a correlated color temperature of light from the second light source module.

2. The lighting apparatus according to claim 1, wherein the first light source module includes a first light emitting element having a spectral emission characteristic defined by a correlated color temperature of light being at least 5400 K and at most 7000 K, Duv being in a range of −6 to 5 inclusive, a chroma value calculated using a calculation method specified by the CIE 1997 Interim Color Appearance Model (Simple Version) being 2.7 or less, and a general color rendering index Ra being 80 or more, and the second light source module includes a second light emitting element having a spectral emission characteristic defined by a correlated color temperature of light being lower than the correlated color temperature of the light emitted by the first light emitting element.

3. The lighting apparatus according to claim 2, further comprising:

an optical member which is disposed on a light emission side of the first light emitting element, and refracts the light emitted by the first light emitting element toward a central axis of the lighting apparatus.

4. The lighting apparatus according to claim 1, wherein an intensity of light from the first light source module at a wavelength of at least 570 nm and at most 780 nm is decreased.

5. The lighting apparatus according to claim 1, further comprising:

a controller which separately controls an output from the first light source module and an output from the second light source module.

6. The lighting apparatus according to claim 1, further comprising:

a controller which controls an output from the first light source module according to an output from the second light source module.

7. The lighting apparatus according to claim 1, further comprising:

a first light distributor which is disposed on a light emission side of the first light source module, and refracts the light from the first light source module toward a central axis of the lighting apparatus.

8. The lighting apparatus according to claim 7, wherein the first light source module includes a plurality of light emitting elements, the first light distributor includes a plurality of reflection members, and the plurality of reflection members individually surround the plurality of light emitting elements.

9. The lighting apparatus according to claim 8, wherein the plurality of reflection members each include a cross-section being an isosceles triangle, the isosceles triangle having a bottom on the light emission side of the first light source module.

10. The lighting apparatus according to claim 8, wherein the plurality of light emitting elements are arranged evenly on the light emission side of the first light source module.

11. The lighting apparatus according to claim 7, wherein the first light source module includes a plurality of light emitting elements, the first light distributor includes a plurality of reflection members, and the plurality of reflection members collectively surround the plurality of light emitting elements.

12. The lighting apparatus according to claim 7, wherein the first light source module includes a plurality of light emitting elements, the first light distributor includes a plurality of lenses, and the plurality of lenses face the plurality of light emitting elements in one-to-one correspondence.

13. The lighting apparatus according to claim 7, further comprising:

a second light distributor which is disposed on a light emission side of the second light source module, and controls a distribution angle of the light from the second light source module.

14. The lighting apparatus according to claim 13, wherein the second light source module includes a plurality of light emitting elements, the second light distributor includes a plurality of lenses, and the plurality of lenses face the plurality of light emitting elements in one-to-one correspondence.

15. The lighting apparatus according to claim 13, wherein the second light distributor includes a reflection member similar to the first light distributor.

16. The lighting apparatus according to claim 1, wherein the second light source module includes a substrate and a plurality of light emitting elements, the substrate has a ring shape, and the plurality of light emitting elements are arranged on the substrate in multiple rings.

17. The lighting apparatus according to claim 16, wherein the plurality of light emitting elements of the second light source module comprise surface-mount white light emitting diodes.

18. A lighting apparatus, comprising:

a first substrate;

a plurality of first light emitting elements disposed on a mounting surface of the first substrate;

a second substrate surrounding the first substrate;

a plurality of second light emitting elements disposed on a mounting surface of the second substrate;

a casing which holds the first substrate and the second substrate; and a pivot which causes the first substrate to pivot relative to the casing, and causes the first substrate to pivot relative to the second substrate, wherein a half beam angle of the plurality of first light emitting elements is smaller than a half beam angle of the plurality of second light emitting elements, and a correlated color temperature of light from the plurality of first light emitting elements is higher than a correlated color temperature of light from the plurality of second light emitting elements.

19. The lighting apparatus according to claim 18, wherein the first substrate is a first printed-circuit board, and the second substrate is a second printed-circuit board.

20. The lighting apparatus according to claim 1, wherein the casing includes an opening, the second light source module is in a ring shape, the second light source module surrounding the opening, and the first light source module is configured to pivot, by the pivot, to cover and expose the opening.

* * * * *